United States Patent [19]

Voltmer et al.

[11] Patent Number: 4,668,327

[45] Date of Patent: May 26, 1987

[54] TAMPER EVIDENT BANDING

[75] Inventors: Helmut Voltmer, Park Ridge; Alfred F. Schwenzer, Totowa; Edward J. Mazur, Montville, all of N.J.

[73] Assignee: New Jersey Machine Inc., Fairfield, N.J.

[21] Appl. No.: 821,426

[22] Filed: Jan. 22, 1986

Related U.S. Application Data

[63] Continuation of Ser. No. 568,642, Jan. 6, 1984, abandoned.

[51] Int. Cl.[4] ..... B42C 9/00; B65C 3/00; B65C 3/24

[52] U.S. Cl. ..... 156/477.1; 156/488; 156/542; 156/DIG. 17

[58] Field of Search ..... 156/475, 477.1, 478, 156/479, 480, 482, 483, 485, 489, 360, 486, 215, 540, 541, 566, 581, DIG. 33, DIG. 42, DIG. 17, 240

[56] References Cited

U.S. PATENT DOCUMENTS

| | | | |
|---|---|---|---|
| 2,891,468 | 6/1959 | Taylor et al. | 156/DIG. 15 |
| 3,780,493 | 12/1973 | Baker | 53/389 |
| 3,802,942 | 4/1974 | Amberg et al. | 156/475 |
| 4,121,404 | 10/1978 | Davis | 53/389 |
| 4,388,143 | 6/1983 | Buchholz et al. | 156/487 |

*Primary Examiner*—David Simmons
*Assistant Examiner*—Louis Falasco
*Attorney, Agent, or Firm*—Charles E. Baxley

[57] ABSTRACT

A dispenser of banding material and an applicator of such material are mounted side by side for location alongside a packaging line during the dispensing and application of an adhesive band to the cover and neck of a container or across the flap and sides of a box-shaped package. A set of pulleys and belts is arranged in two parallel rows along the underside of the applicator for contacting the covers and upper portions of containers and other packages. The heights of the belts is adjusted to accommodate undulations in the exterior surface of the package so as to provide for adhesive securing of a band along these undulations. Such securing of the band insures a destruction of the band upon any opening or attempted opening of the container.

3 Claims, 15 Drawing Figures

TAMPER EVIDENT BANDING

This is a continuation of application Ser. No. 568,642, filed Jan. 6, 1984 now abandoned.

BACKGROUND OF THE INVENTION

This invention relates to packaging equipment and, more particularly, to incorporation of labeling equipment into a packaging line for applying a band across a cover of a package to indicate opening of the cover.

Packages come in a large variety of sizes and shapes to fit particular products being marketed. Of particular interest is the nature of packaging utilized for protecting products, such as drugs, which are to be consumed by the public. Protection of such products necessitates some form of assurance to a consumer that the package has not been tampered with, more particularly that the cover of the package has not been opened and replaced. Outbreaks of tampering with non-prescription drug packages have made necessary installation of equipment which readily can convert packaging lines to provide an additional step of affixing some form of closure seals to packages to show evidence of tampering; hence, a "tamper evident" closure seal.

A problem exists in that no equipment has been available commercially which can readily convert a packaging line to provide the necessary banding with the appropriate seals. Attempts to utilize existing protective coverings are costly in both a financial sense, and in a sense of requiring additional space in the packaging facility. Current "closure to package" tamper resistant seals made of shrink fit plastic film, which embrace both the sides of the closure and the neck of the package, require special equipment to be added to the packaging line, in order to apply the closure seals. Also, wrapping the container in heat sealable "tamper evident" films requires additional equipment to perform the wrapping operation.

Each of the foregoing approaches calls for the packaging line to be extended in order to incorporate necessary additional machinery. This extension involves considerable expense and is also time consuming. Packaging areas also may have to be reoriented or extended in order to find for the machinery a place within the facility in which the packaging is taking place.

SUMMARY OF THE INVENTION

The foregoing problem is overcome and other advantages are provided by means of a banding system incorporating this invention. Upon implementation of the banding system, the invention can be practiced simply by inclusion of an attachment to the operating section of currently used in-line labeling machinery. Such an inclusion can be accomplished, with current packaging equipment, within the time intervals between operating shifts or over a weekend.

A typical packaging line incorporates the functions of cleaning, filling, capping, and labeling. Such operations require a certain amount of space for emplacement of the equipment. Typically, a minimum of approximately five feet is required between the capping and the labeling equipment in order to accommodate variation in the rate of flow of products along the packaging lines, as well as to allow for changes in label supply.

It is, therefore, an object of the invention to provide for a dispensing mechanism and a label or band applying mechanism which may be self-contained and free-standing. It is a further object of the invention to provide for an implementation of the foregoing mechanism which permits the invention to be moved into position over the section of a packaging line between the capping and the labeling equipment.

The invention is implemented in conjunction with a conveyer of packages, for example, medicine bottles, wherein the conveyer advances the bottles along the packaging line. A "tamper evident" band or seal is carried by a web to a point above a package, whereupon the dispensing equipment applies the band to the package as the package passes under the dispensing unit. The movement of the package past the dispensing unit is accomplished by the conveyor. A package director such as a microswitch or photoelectric sensor signals the dispenser to feed a label or band upon the top of the package. Release of a band from the web is accomplished as the web bends sharply upon itself at a peel point of the dispenser equipment, such peel point being a common device utilized in dispensers of pressure sensitive labels.

The equipment of the invention incorporates a supporting frame upon which is disposed a nose pulley which carries a top clamping belt; the belt engages with the top of a package and progressively presses the release portion of an adhesively coated side of the band against the top surface of a cap or cover of the package. The top clamping belt is driven by a variable speed motor which may be manually or automatically synchronized to match the linear velocity of the belt to the speed of the conveyor. Such synchronization is readily accomplished by conventional utilization of microswitches and/or photoelectric sensors responsive to the location of a package on a conveyor.

The frame further supports a first pressure roll, a second pressure roll, and a pair of pulleys carrying a tucking belt for exerting pressure along the side of the cap or cover for securing the band thereto. The pressure rolls and the pulleys are rotated about vertical axes and may be positioned adjustably at different heights above the conveyor for engagement with different parts of the sides of the covers or caps of the packages. The top clamping belt presses downwardly on the packages so as to aid in maintaining their positions along the conveyor for receiving the side thrusts of the pressure rolls and the tucking belt. Preferably, the rolls and belts are arranged in pairs on opposite sides of the packages for balancing the thrusts.

The foregoing frame also supports a pair of adjustably mounted plows which continue the downward bending of a band along the sides of a package cover as the package moves along the conveyor.

With respect to the case of the packaging of medicine within a bottle, the band is securely fastened by the adhesive to both the cap and the bottle. Clear evidence of tampering is obtained by a tearing of the band in an attempt at removal of the cap from the bottle. Such tearing is accomplished by providing an adhesive strength to the band which is stronger than the material strength of the band. Release of the cap from the bottle can be accomplished only by a tearing of the band since the adhesive precludes removal of the band without destroying the band. Any tear in the band is a sign that some attempt has been made to remove the cap from the bottle. The invention is equally applicable to other forms of packaging, such as rectangular boxes, in which the band is applied to the peripheral region of a flap cover. Opening of the cover requires a tearing of the band which is evidence of the opening. In the case of a packaging line employing equipment which applies a decorative seal, the banding equipment of the invention may be inserted in the packaging line before the equipment which applies the decorative seal. The decorative seal then would cover the end of the band, the mid-portion of the band being fully visible to show any evidence of tearing and opening of the package.

BRIEF DESCRIPTION OF THE DRAWING

The foregoing aspects and other features of the invention are explained in the following description, taken in connection with the accompanying drawing wherein.

DETAILED DESCRIPTION

This description of the invention is applicable to labeling of packages of various shapes, including boxes, tubes, and bottles. With respect to shapes of bottles, the bottles may be long and narrow, or short and wide, and may have rounded sides or flattened sides. Caps may be secured to the bottles by use of a screw-on thread, or by use of a push-on lip. In all cases, security against tampering is provided to warn a user that an opening, or attempted opening, of the bottle or box has taken place. The security is provided by the application of a tamper-evident band or seal which is configured in the form of a label and is affixed by an adhesive to the package by label applying machinery constructed in accordance with the invention.

First, the band or label is secured to the top portion of a cap or flap as the closed package moves along a packaging line in a facility of conventional packaging equipment. After the initial step of affixing the label to the top of the cap or the top of the flap, the machinery of the invention performs a further step by securing the balance of the band, which may be in the form of a leg, to a side of the box or bottle. In performing the second step, the leg of the band passes over the peripheral edge of the cover and the peripheral edge of the side wall of the package, so that the cover cannot be opened without a tearing of the band. In the case of a bottle having a screw-on cap, the cap has side walls which extend over the opening of the bottle and, accordingly, the label is affixed also to the sidewall of the cap. Thereby, an attempted opening of the bottle results in a tearing of the banding label at the peripheral edge of the side wall of the cap.

Figure 1:
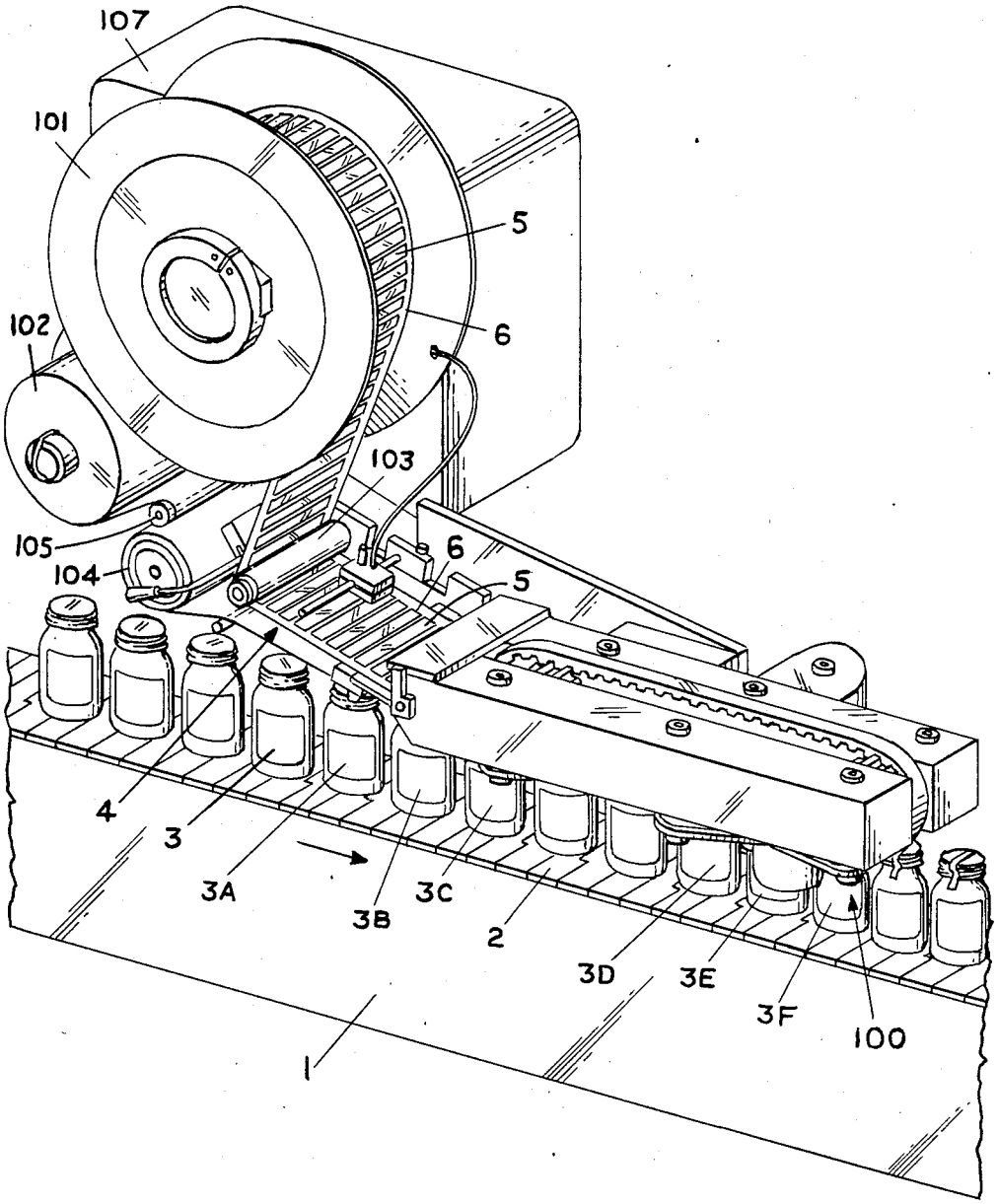
FIG. 1 is a perspective view of a band dispensing mechanism and a band applying mechanism of the invention.
Figure 2:
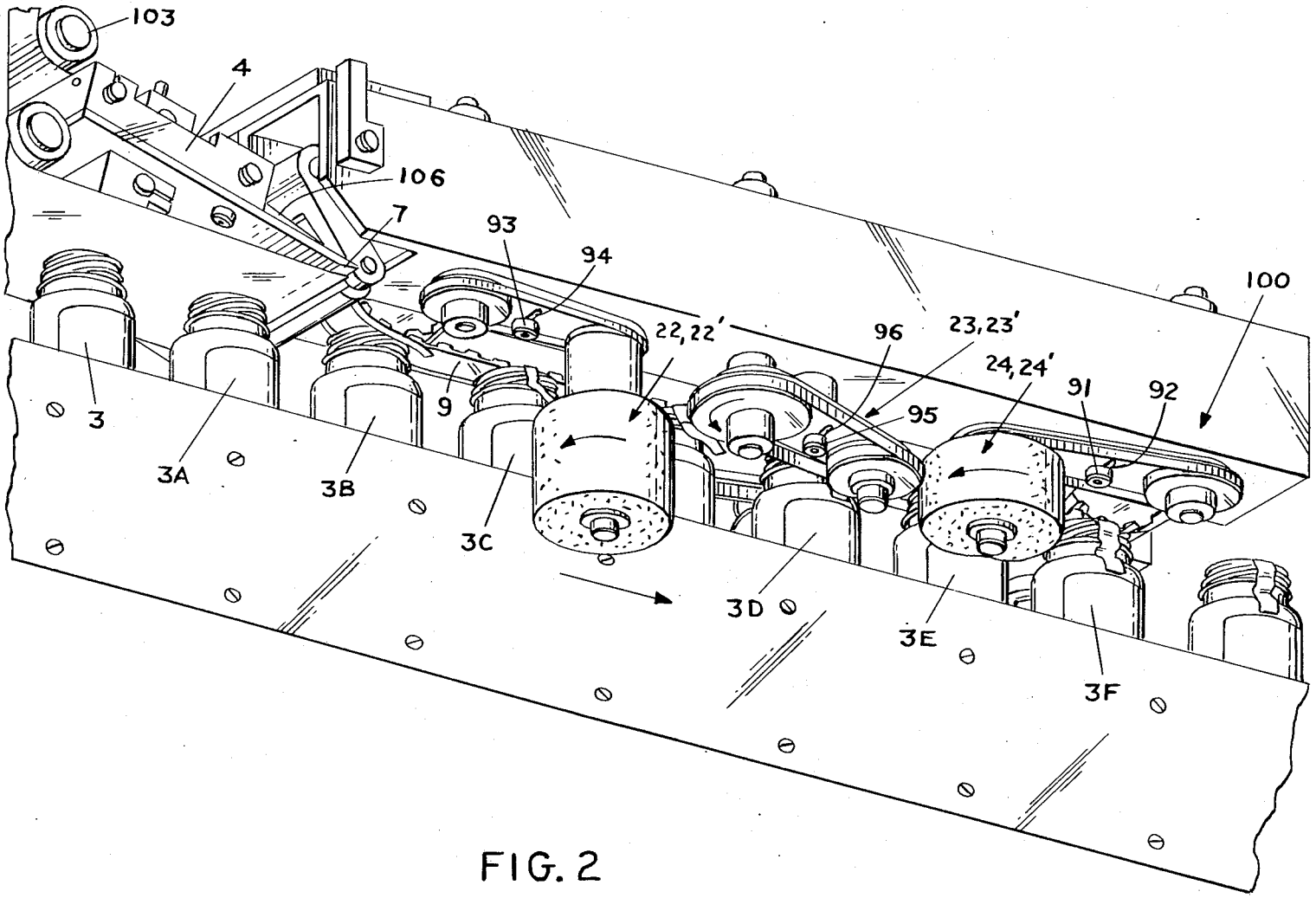
FIG. 2 is a perspective view of a portion of the equipment of FIG. 1, the view of FIG. 2 being elevated to show the underside of a roll and belt assembly of the band applying mechanism, the view further showing the contacting of rolls and belts with capped bottles carried by a conveyor.

With reference to the figures of the drawing, the packaging line includes a frame 1 which supports a conveyor 2. Packages 3 are conveyed via the conveyor 2 past a dispenser 4 of labels or bands 5 which are used to seal the packages 3. By way of example, the packages 3 are shown as glass jars with screw-on covers or caps. Specific locations of packages 3 useful in explaining the invention are further identified in FIGS. 1 and 2 via the legends 3A–3F. The dispenser 4 is of a conventional form utilized in the dispensing of pressure sensitive bands 5; the bands 5 are carried in a conventional manner upon a web 6.

Figure 7:
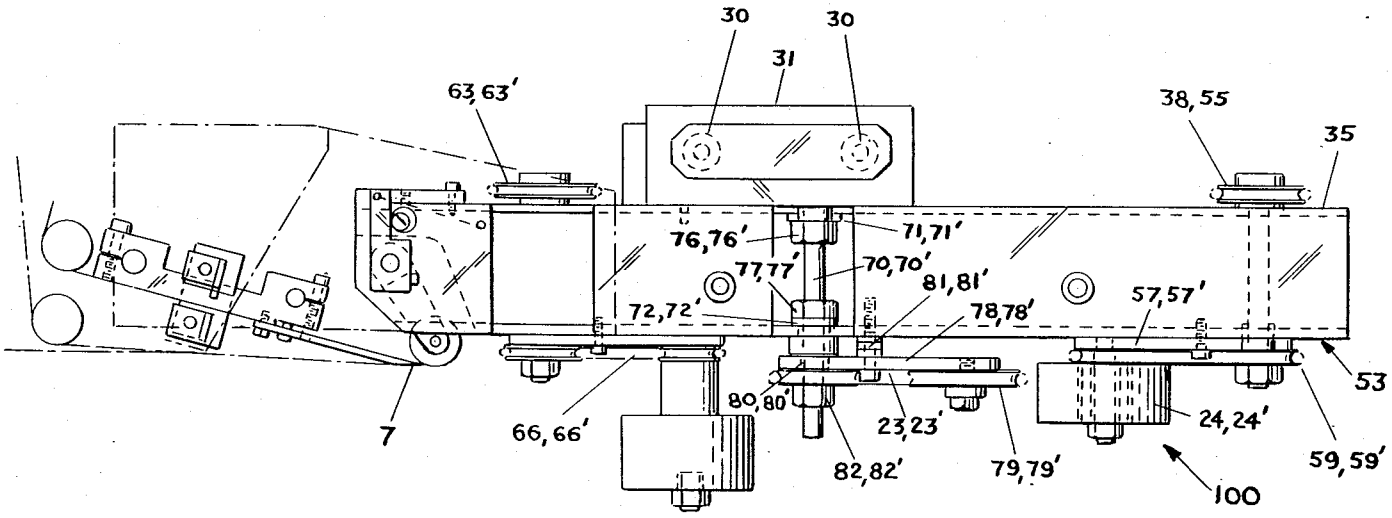
FIG. 7 is a further side elevation view of the dispensing and applying mechanisms of FIG. 1, the view of FIG. 7 including the tucking belt, but being simplified by deletion of a motor of FIG. 3.

The dispenser 4 includes a dispensing or peel point 7 (FIGS. 2, 3 and 7) about which the web 6 is sharply bent back to release a band 5 upon the top of a package 3. Synchronization of the movement of a package 3 with the movement of a band 5 on the web 6 is accomplished by means of a photoelectric sensor 8 (FIGS. 9, 10 and 11) providing a beam of light directly within the path of the packages 3. As a moving package 3 breaks the beam of light, the sensor 8 provides an electric signal which operates the dispenser 4 to advance the web 6 by one band spacing. Thereby, a band 5 advances to the peel point 7 in synchronism with the movement of a package 3 at position 3A whereby the band 5 contacts the package 3 upon separation from the web 6.

After receiving a band 5, a package 3 is conveyed by the conveyor 2 from the dispenser 4 to an applicator 100 which securely affixes the band 5 to the package 3. Thus, in the exemplary case wherein the package 3 is a glass jar having a screw-on cover, the applicator 100 presses the band 5 along the cover, and further applies the end or leg portions of the band to the sides of the cover and to the neck of the jar, as will be described herein below.

In accordance with the invention, the applicator 100 comprises a top clamping belt 9 which passes around and is supported by a nose pulley 10. The applicator 100 further comprises a support arm 11 from which depend nose bearing blocks 12 and 12' for support of the pulley 10. The nose pulley 10 is rotatably mounted in the bearing blocks 12 and 12' via a pulley shaft 13 which serves to exert pressure via the pulley 10 and the belt 9 to the band 5 for sealing the band to the top of the jar cover. Also mounted on the nose pulley shaft 13, and rotatably driven by this shaft 13, are a pair of side rollers 14 and 14' having diameters slightly larger than the combined outer diameter of the nose pulley 10 plus the thickness of the clamping belt 9. The two side rollers 14 and 14' are adjusted in position along the nose pulley shaft 13 to provide a gap between the two rollers 14 and 14' slightly less than the diameter of the jar cover. Thereby, as the package 3 with the band 5 thereon passes between the side rollers 14 and 14', the inner faces of the side rollers 14 and 14' contact the cover and the band so as to crease the band 5 downward along both sides of the cover.

The applicator 100 further comprises a pair of adjustably mounted bending plows 15 (FIG. 5) and 15' which continue the downward bending of the label 5 along the sides of the cover and the neck of the jar as the jar is further conveyed by the conveyer 2 through the applicator 100. The applicator 100 incorporates a frame 16 best shown in FIGS. 3 and 5 to which the bending plows 15 and 15' are mounted by adjusting bars 17 and 17'. Vertical adjusting blocks 18 and 18' connect the bars 17 and 17' to the frame 16, and plow support slide blocks 19 and 19' connect the bars 17 and 17' with the plows 15 and 15'. Thereby, the position of the plows 15 and 15' relative to the packages 3 can be adjusted to provide for the continued downward bending of a band 5. Also, a spring 20 connects between the frame 16 and the arm 11 to provide a spring biased force to the arm 11, which force is coupled via the nose pulley shaft 13 to a band 5 during the securing of the band 5 to the jar cover.

The clamping belt 9 is driven by a motor 21 mounted on top of the frame 16. Synchronization of the speed of the clamping belt 9 with the conveyor 2 is accomplished by adjusting the speed of the drive motor 21. Thereby, the synchronization of the two speeds allows the packages 3 to be clamped firmly between the belt 9 and the conveyor 2. At the package position 3B, there occurs the foregoing engagement between the package 3 and the bending plows 15 and 15'. Upon further movement of the package 3 by the conveyor 2 to the position 3C, the package 3 makes contact with a pair of resilient side pressure rolls 22 and 22'. The rolls 22 and 22' are supported by the frame 16 and are driven by the motor 21 at a rate of rotation wherein the peripheral speed of the rolls 22–22' is equal to the speed of the package 3 as it passes between the rolls 22–22'. The gap between the rolls 22–22' is adjusted to a spacing slightly less than the diameter of the jar so as to permit these rolls to press the band 5 against the sides of the jar as the jar passes between the rolls 22–22'.

Further movement of the conveyor 2 moves the package 3 to the position 3D wherein engagement is made with a pair of side tucking belts 23 and 23' which are supported by the frame 16 and are driven by the motor 21 at a speed commensurate with the speed of travel of a package 3 through the applicator 100. The belts 23–23' press the band 5 into a gap created between the bottom of the jar cover and the neck of the jar. The tucking belts 23–23' are adjustable vertically to a desired height above the conveyor 2 in order to press the band 5 across the bottom of the jar cover so as to accommodate different heights of jar cover to accommodate different sizes and shapes of packages 3.

With further movement of the conveyor 2, the package 3 arrives at the position 3E wherein contact is made with a pair of resiliently covered closure side pressure rolls 24 and 24' which are supported by the frame 16 and are adjustable in the horizontal position so as to produce a gap between the rolls 24–24' which is slightly less than the diameter of the jar cover. With the foregoing gap position, the rolls 24–24' are able to press the ends of the band 5 down against the sides of the jar neck to complete the sealing of the band 5 to the package 3 as shown at position 3F.

Figure 9:
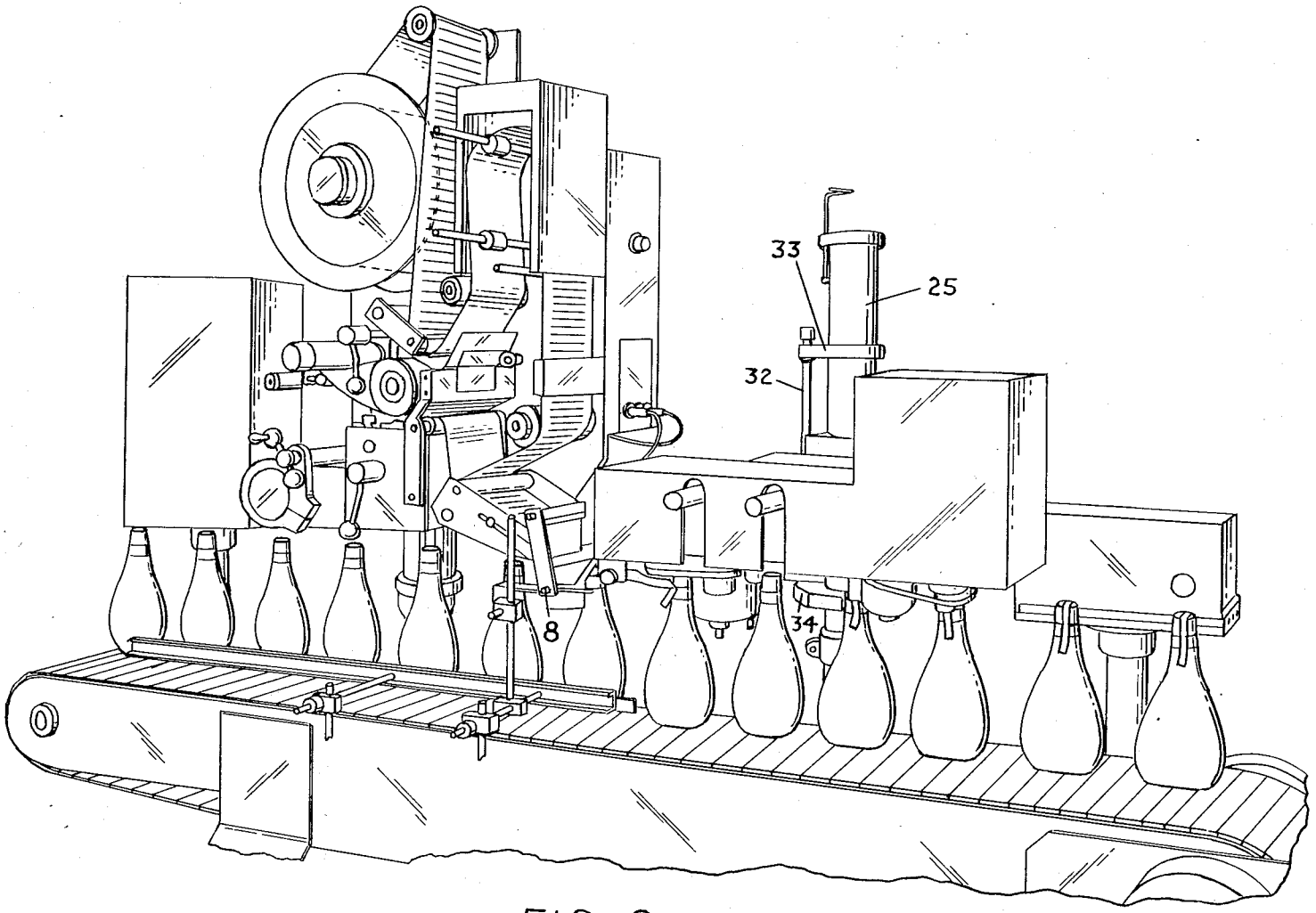
FIG. 9 is a perspective view of a packaging line incorporating the invention, the view in FIG. 9 showing an enclosing case of the applying mechanism and the upper portion of a support for elevating the applying mechanism.
Figure 10:
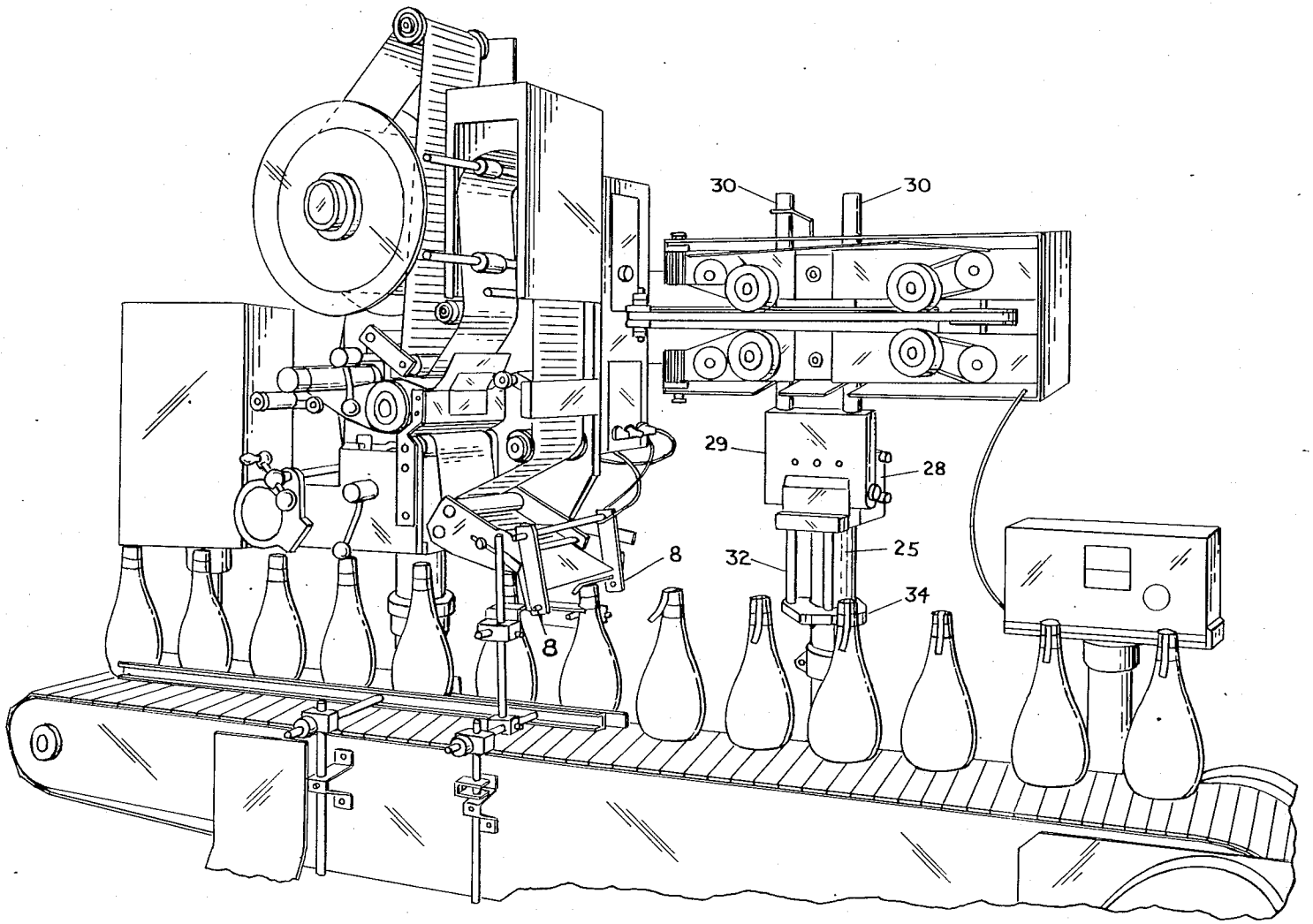
FIG. 10 is a perspective view of equipment shown in FIG. 9, with the applying means being pivoted upwardly and away from packages carried by a conveyor.
Figure 11:
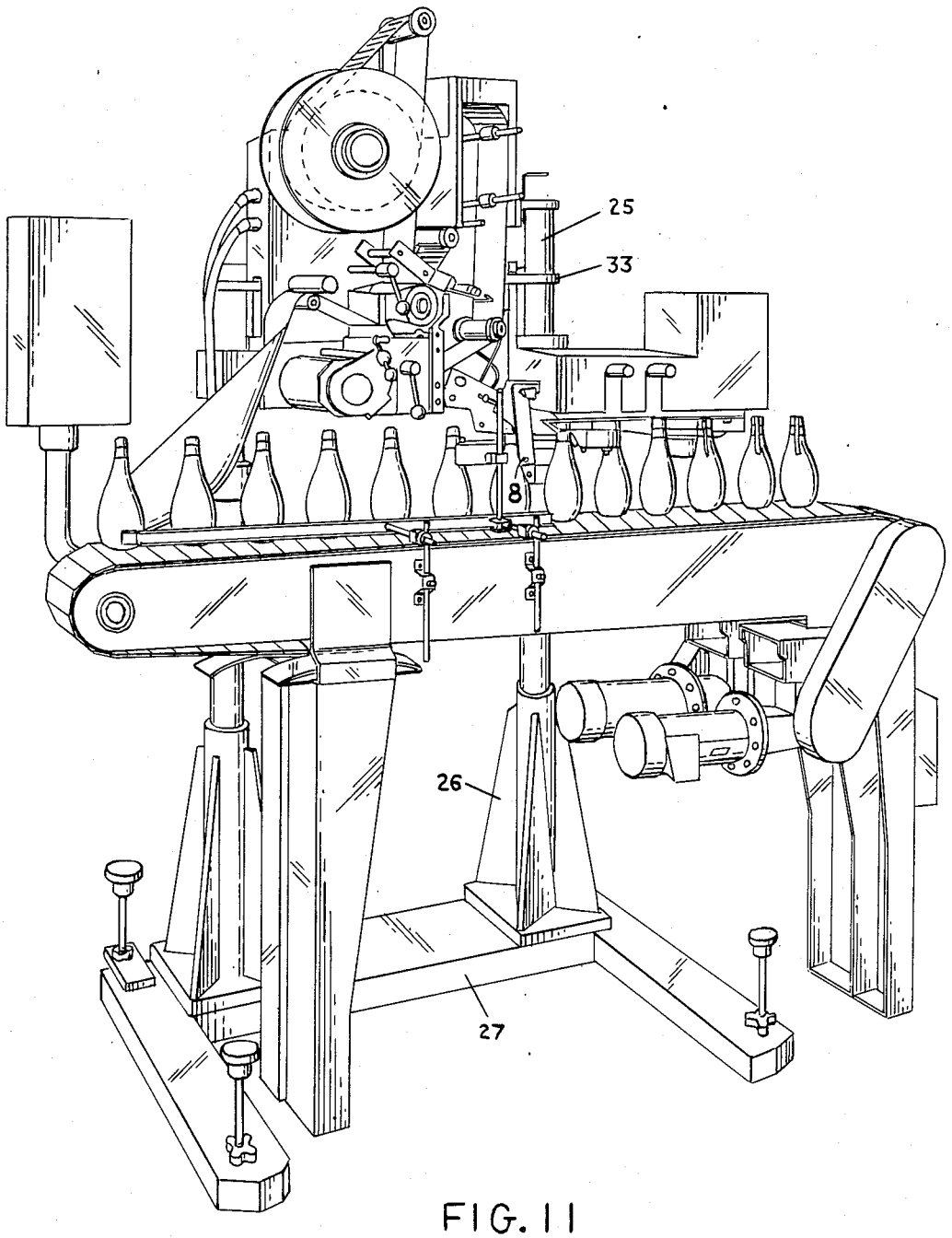
FIG. 11 is a further perspective view of the equipment of FIG. 9 showing a stand for supporting the band dispenser mechanism and the band applying mechanism alongside the conveyor.
Figure 12A:
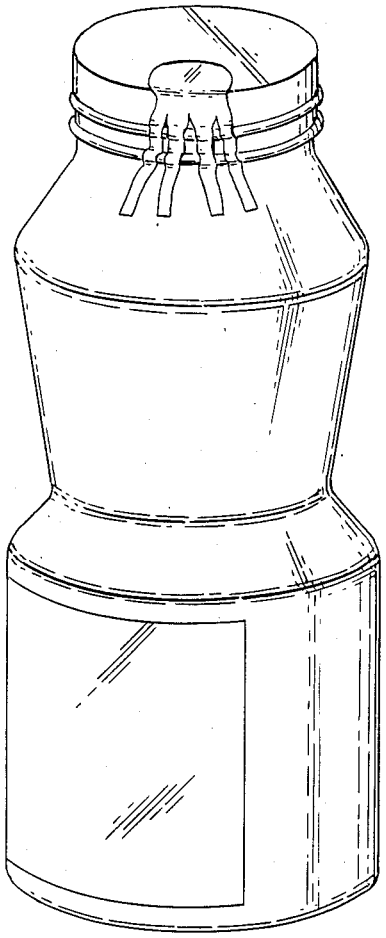
FIGS. 12A–D show stylized views of various packages and bands applied to the covers and the sides of packages by the equipment of FIGS. 1 and 9.
Figure 12B:
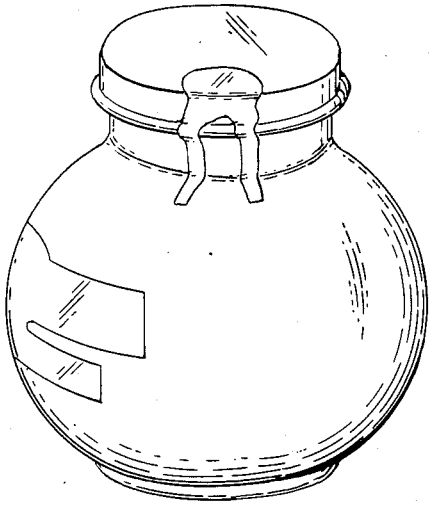
Figure 12C:
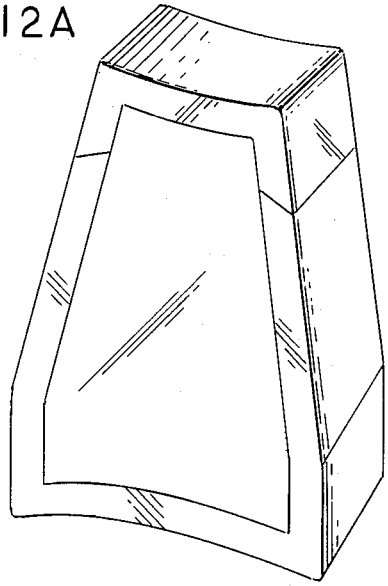
Figure 12D:
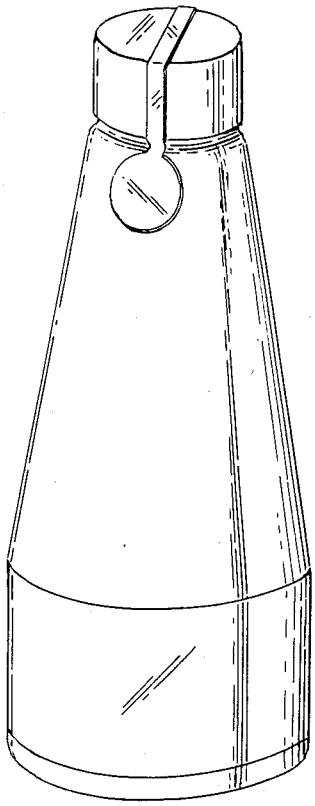

The applicator 100 is secured to a vertical support column 25 which is mounted by means of a flange 26 to a supporting base 27 (FIGS. 9–11). The base 27 also supports the dispenser 4. Securing of the applicator 100 to the column 25 is accomplished by means of a hinge assembly which comprises a block 28, a hinge 29, support bars 30 and a support block 31. The bars 30 extend from the block 29 which, in turn, is hinged to the block 28. The block 31 is secured to the frame 16 and is slidably mounted on the bars 30 to provide for horizontal adjustment in the position of the applicator 100 when the applicator 100 is swung down into operating position above the conveyor 2. The height of the block 28 and of the applicator 100 supported thereon may be adjusted by a vertical adjusting screw 32 with an associated upper adjusting screw support 33 and a lower adjusting screw support 34. As shown in FIG. 10, the applicator 100 may be swung upwardly out of position when banding of the packages 3 is not required. Upon being placed in operating position, as shown in FIGS. 9 and 11, the applicator 100 is slid along the bars 30 (FIG. 4) for positioning the clamping belt 9 above the packages 3. The block 31 may be locked by conventional means (not shown) to the bars 30 to hold the applicator in the selected position above the conveyor 2.

The motor 21 is mounted on a mounting surface 35 of the frame 16 by means of mounting spacers 36. The motor 21 is commercially available, variable speed type of motor having a gear head drive. The motor 21 drives through a vertically disposed shaft 37 into a coupling mounted sprocket 38, the latter connecting with a vertical drive shaft 39 mounted in bearings 40 and 41.

Figure 4:
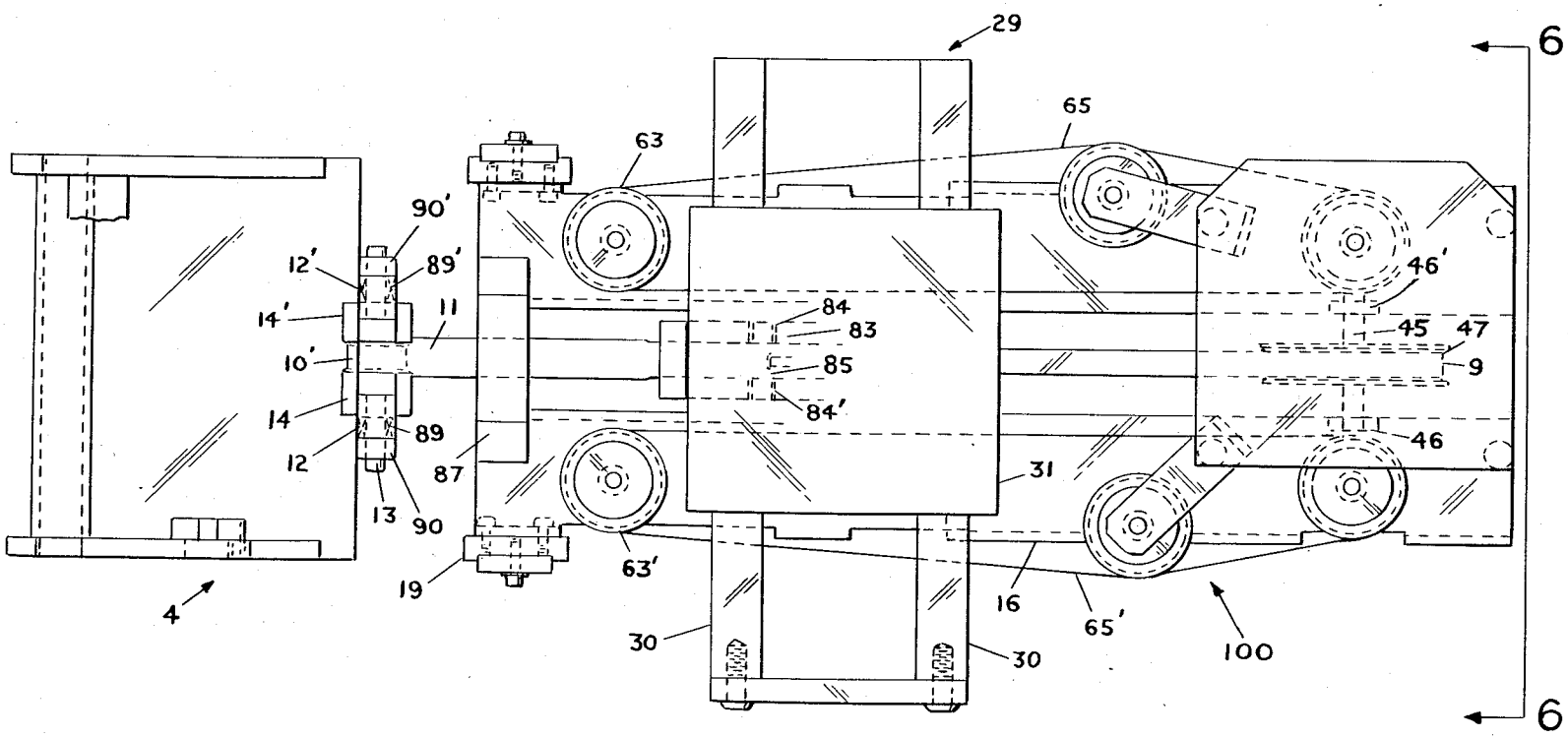
FIG. 4 is a plan view of the equipment shown in FIG. 3.
Figure 6:
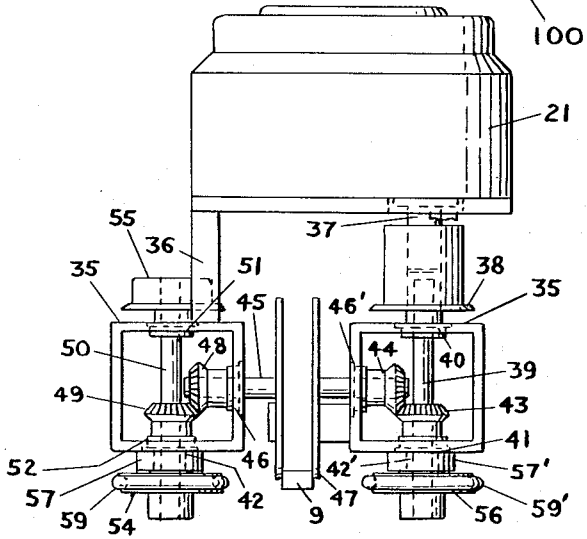
FIG. 6 is an end view of the band applying equipment of FIG. 3, taken along the line 6—6 in FIG. 4.

As shown in FIGS. 4 and 6, the shaft 39 drives through miter gears 43 and 44 to a shaft 45. The gear 43 is secured to the shaft 39, the gear 44 is secured to the shaft 45 and the gears 43 and 44 mate with each other to impart rotation of the shaft 39 to the shaft 45. The shaft 45 is rotatably supported in bearings 46 and 46' for rotation of a drive pulley 47 secured to the shaft 45. The pulley 47 carries an end of the top clamping belt 9, the opposite end of the belt 9 being carried by the nose pulley 10 as has been noted above.

At the outer end of the shaft 45 there is mounted a miter gear 48 which drives a further miter gear 49 mounted on a vertical shaft 50. The shaft 50 is rotatably supported in bearings 51 and 52 secured to the frame 16. The shaft 50 carries on its lower end and on its upper end, respectively, a belt pulley 54 and a sprocket 55. Also, the shaft 39 carries on its lower end a pulley 56.

Support arms 57 and 57' are located at the lower horizontal mounting surface 53 of the frame 16, and are pivotally mounted on ends of the vertical shafts 50 and 39, respectively, by bearings 42 and 42'. The outer ends of the arms 57 and 57' carry support, studs 58 and 58' upon which are rotatably mounted the closure side pressure rolls 24 and 24'. The upper portions of the pressure rolls 24 and 24' include grooves for receiving, respectively, drive belts 59 and 59', the latter being driven, respectively, by the pulleys 54 and 56. Thereby, rotation of the pulleys 54 and 56 impart rotation to the pressure rolls 24 and 24'. The direction and speed of the rotation is such that the portions of the rolls 24 and 24' which press against a band 5 on a package 3 move with a direction and speed equal to that of the package 3 advancing along the conveyor 2.

The amount of pressure exerted by the closure side rolls 24 and 24' against the package 3 may be adjusted by positioning the support arms 57 and 57'. The rolls 24 and 24' are made of a resilient material, such as a closed-cell foamed plastic material, which exerts a force dependent on the spacing between the mounting studs 58–58' and the center line of a package 3. The support arms 57 and 57' may be swung to the desired position and then locked to the lower mounting surface 53 of the frame 16 by conventional means, such as by the use of tightening screws 91 (FIG. 2) riding in arcuate slots 92 in the support arms 57 and 57'.

At the opposite end of the frame 16 are located jackshafts 60 and 60' (FIG. 3) which are rotatably mounted in bearings 61, 61', 62 and 62' secured to the frame 16. Sprockets 63–63' and pulleys 64–64' are mounted respectively at the top and bottom ends of the jackshafts 60–60'. The sprockets 63–63' are driven, respectively via chains 65–65' (FIG. 4) from the aforementioned sprockets 55 and 38.

Additional support arms 66 and 66' are pivotally mounted on the ends of the jackshafts 60–60' via bearings 67–67', and carry on their outer ends studs 68–68', respectively, for rotatably supporting the aforementioned pressure rolls 22 and 22'. The rolls 22 and 22' have grooves on their upper ends for receiving drive belts 69–69', the latter being driven by the pulleys 64 and 64'. Rotation of the jackshafts 60–60' imparts rotation to the pulleys 64–64' which, in turn, impart rotation to the pressure rolls 22 and 22' in a direction and a speed for matching the peripheral portions of the rolls 22 and 22' to the direction and speed of a package 3 travelling along the conveyor 2. The jackshafts 60 and 60' are rotated by the sprockets 63–63' in response to rotation of the sprockets 55 and 38. The rolls 22 and 22' are also fabricated of a resilient material, and the amount of pressure exerted by these rolls against the package 3 may be adjusted by swinging the support arms 66–66' for positioning the rolls 22–22' in a desired amount of proximity to the path of travel of the packages 3. The support arms 66–66' may be locked into position by conventional means (FIG. 2) such as by the tightening of screws 93 secured in the lower mounting surface 53 of the frame 16 and riding in arcuate slots 94 in the support arms 66–66'.

Figure 3:
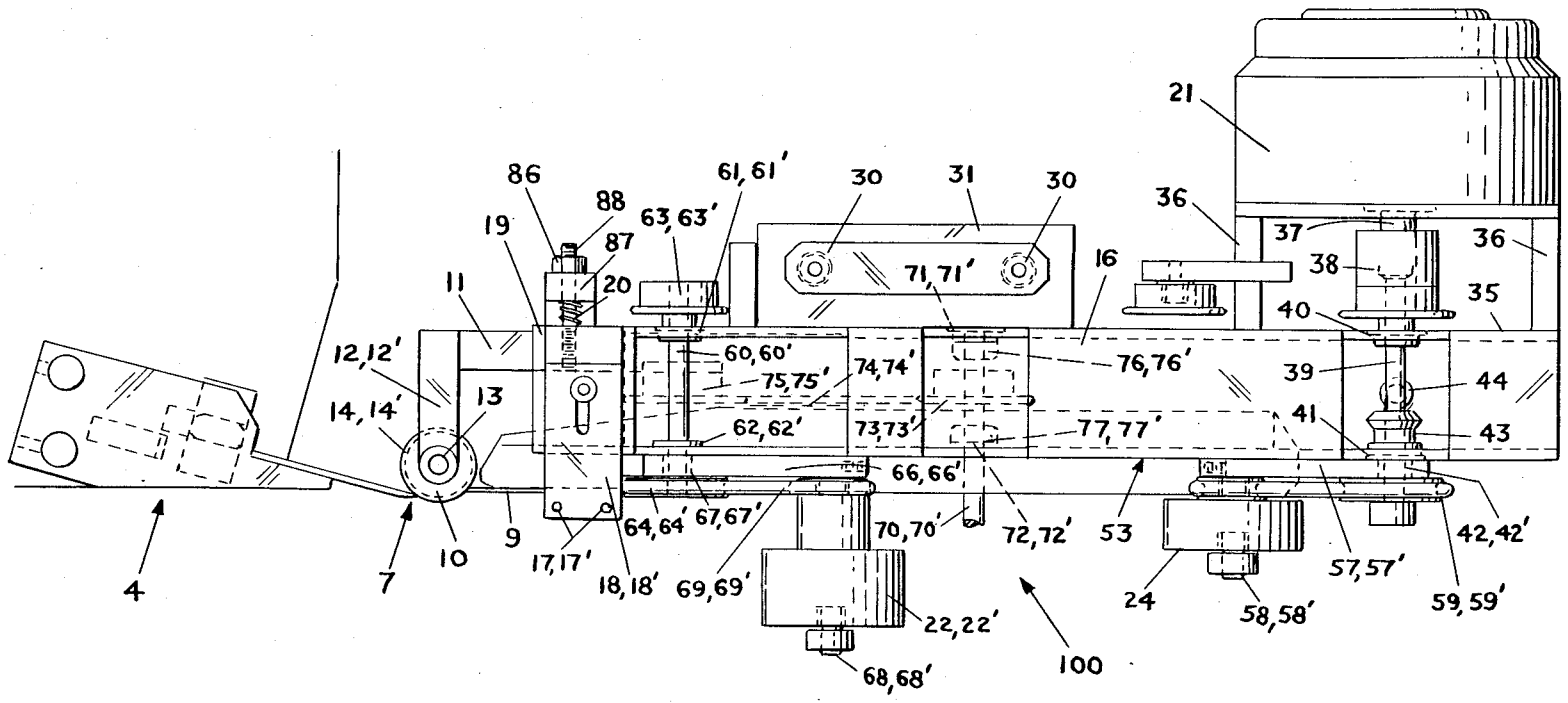
FIG. 3 is a side elevation view of the dispensing and applying mechanisms of FIG. 1, the view of FIG. 3 being simplified by deletion of a tucking belt to facilitate explanation of the invention.
Figure 8:
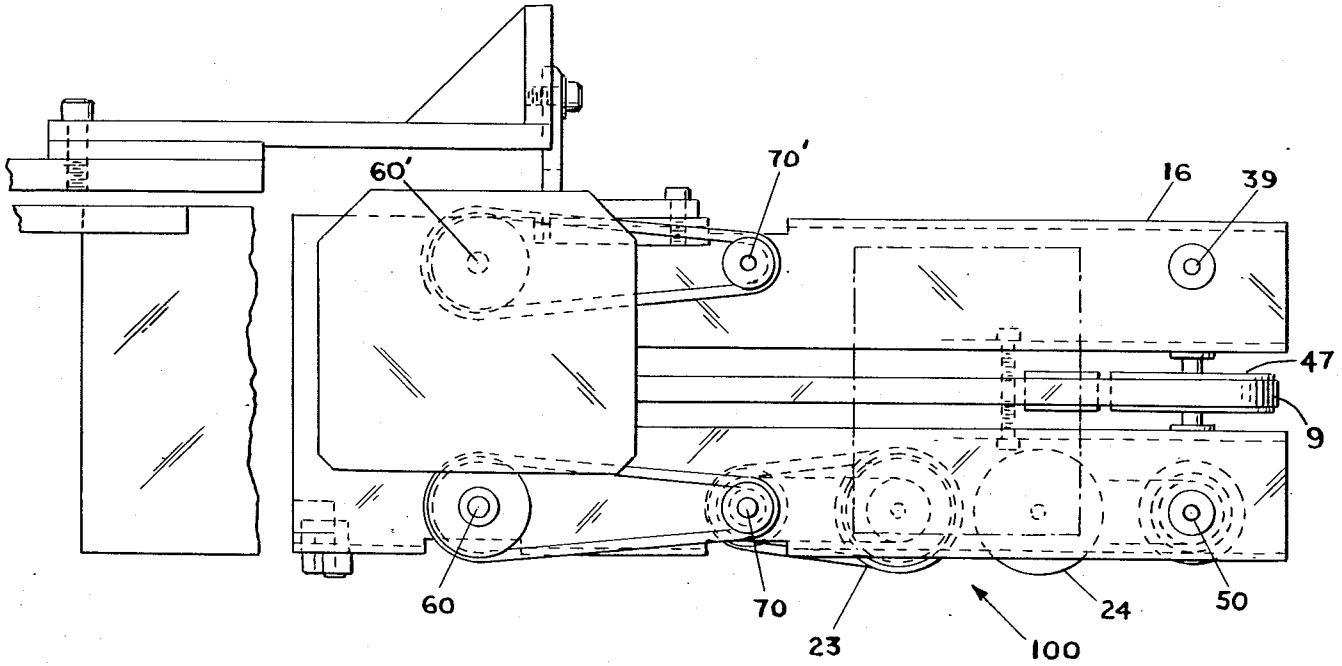
FIG. 8 is a partial plan view of the applying mechanism of FIG. 7.

The side tucking belts 23–23' are mounted and driven in a similar fashion to that described above for the pressure rolls 22–22' and the closure side rolls 24–24'. Additional jackshafts 70–70' (FIGS. 7 and 8) are rotatably mounted in bearings 71–71' and 72–72' secured to the frame 16. Sprockets 73–73' are mounted to the jackshafts 70–70' between the bearing sets 71–72 and 71'–72'. The sprockets 73–73' are driven by chains 74–74' from sprockets 75–75' which are mounted to the aforementioned jackshafts 60–60' (FIG. 3). The jackshafts 70–70' are retained in their respective vertical positions by collar sets 76–77 and 76'–77'. The jackshafts 70–70' extend downward beneath the frame 16 to allow for a vertical positioning of arms 78–78' which support the side tucking belts 23–23'.

The support arms 78–78' hold the belt pulleys 79–79' which are rotatably mounted to the outer ends of the arms 78–78'. The inner ends of the arms 78–78' are pivotally mounted by bearings 80–80' to the lower ends of the jackshafts 70–70' to permit the arms 78–78' to be swung to a desired position for locating the belt pulleys 79–79' with a desired spacing from the path of travel of the packages 3 along the conveyor 2. Adjustment of the height of the tucking belts 23–23' above the conveyor 2 is accomplished with the aid of spacers 81–81' and also by the clamping of belt drive pulleys 82–82' at selectable positions from the ends of respective jackshafts 70–70'. The swinging and locking of the arms 78–78' for the horizontal positioning of the tucking belts 23–23' is accomplished in the same manner, by means of screws 95 and slots 96 (FIG. 2), as has been described above with respect to the support arms 57–57' and the support arms 66–66'.

Figure 5:
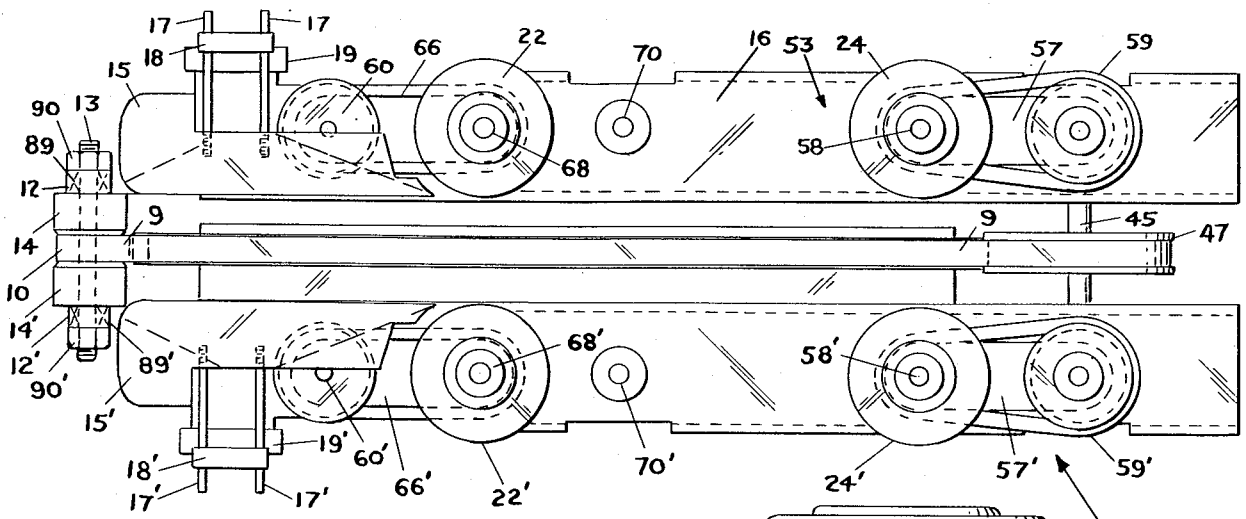
FIG. 5 is a bottom view of the roll and belt assembly of FIG. 3.

With further reference to the previously described support arm 11 (left side of the frame 16 in FIGS. 3, 4 and 5, further data on the mounting of the support arm 11 to the frame 16 is now provided. Secured to the frame 16 is a hinge support 83 having bearings 84–84'. An end of the support arm 11 is secured to a hinge pin 85 which is supported within the bearings 84–84'. Thereby, the support arm 11 can pivot in the vertical plane. Above the spring 20 there is provided a stop nut 86 and a bridge 87. A threaded stud 88 passes through the bridge 87 and the spring 20 to the arm 11. The nut 86 is secured to the upper end of the stud 88 and abuts the bridge 87. Tightening of the nut 86 raises the arm 11 to a desired position, with further raising against the force of the spring 20 occurring upon a pressing of the top of a package 3 against the belt 9 and the nose pulley 10. The nose bearing blocks 12–12' are provided with bearings 89–89' which support the pulley shaft 13 about which the nose pulley 10 turns. The shaft 13 is held in position by collars 90–90'. Thereby, the nose pulley 10 and the clamping belt 9 are secured in their respective positions above the path of travel of the packages 3 while adjustment for slight variations in height of the packages 3 is accomplished automatically with the aid of the spring 20.

With reference to the dispenser 4 referred to above, further details in the construction thereof are as follows. The dispenser 4 comprises a supply roll 101 about which the web 6 with the bands 5 thereon is initially wound, and a take-up roll 102 about which the web 6 is wound after the dispensing of the bands 5. Intermediate idler roll 103 is positioned along the path of travel of the web 6 between the supply roll 101 and the take-up roll 102 for guiding the web 6 by means of guides 106. The guides 106 extend from the dispenser 4 and terminate in the aforementioned peel point 7 where the bands 5 separate from the web 6 to become lodged upon the packages 3. A motor 107 drives the take-up roll 102 and the feed roll 104 for advancing the web 6.

The foregoing embodiment of the invention has provided for a band dispenser and applicator which can be readily positioned alongside a packaging line. The assembly of belts and pulleys within the applicator are readily positioned alongside the covers of packages for securing a band thereto, the applicator being readily swung up out of the path of moving packages when no such banding is required. The use of the banding equipment of the invention does not interfere with other packaging equipment which may be present on the packaging line. The two rows of symmetrically positioned pulleys and belts, in combination with the top clamping belts and the plows provide for a sequential attachment of a band beginning at the top center of a package cover, and continuing down the sides of the cover for a precisely positioned and secured band on the top portion of a package. In particular, it is noted that the use of plural belts at different heights above the conveyor provides for the tucking of sections of a band so as to follow an undulating surface of cover and container. The precise adherence of the band at the interface between the cover and the container insures a destruction of the band upon any opening or attempted opening of the container.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

We claim:

1. A system for applying a banding label to a cover and a side of a package, the label having thereon contact means for maintaining contact between the label, the cover and the side of the package and the contact means being stronger than the label to force a tearing of the label when the package is opened, so that the tearing shows evidence of such opening, said system comprising a label dispenser, label application means and a conveyor for carrying packages past the dispenser and the label applicator means, a device for placing a label on the top of the cover with a section of the label extending beyond an edge of the cover said label applicator means including a clamping belt for engaging the label to seal the same to the top of the cover, bending and pressing means for thereafter bending the section of the label downwardly along at least one side of the cover and pressing the same thereagainst, and side pressure rolls for thereafter pressing the label against the side of the package, said clamping belt continuing to engage the label as said conveyor moves the package past said bending and pressing means and said side pressure rolls.

2. A system according to claim 1 wherein said bending and pressing means comprises a pair of adjustable side rollers and a pair of adjustable bending plows.

3. A system according to claim 1 wherein said side pressure rolls are resilient.

* * * * *